US006212906B1

(12) United States Patent
Lau et al.

(10) Patent No.: US 6,212,906 B1
(45) Date of Patent: Apr. 10, 2001

(54) CRYOGENIC REFLUX CONDENSER SYSTEM FOR PRODUCING OXYGEN-ENRICHED AIR

(75) Inventors: Andrew Chun-Pong Lau, Williamsville; Thomas John Bergman, Jr., Clarence Center; John Fredric Billingham, Getzville; Tu Cam Nguyen, Tonawanda, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/504,904

(22) Filed: Feb. 16, 2000

(51) Int. Cl.[7] ..... F25J 3/00
(52) U.S. Cl. ..... 62/641
(58) Field of Search ..... 62/641, 638

(56) References Cited

U.S. PATENT DOCUMENTS

| | | | |
|---|---|---|---|
| 3,983,191 | 9/1976 | Schauls | 261/114 |
| 4,025,398 | 5/1977 | Haselden | 203/25 |
| 4,234,391 | 11/1980 | Seader | 203/26 |
| 4,308,043 | 12/1981 | Yearout | 62/13 |
| 5,144,809 | 9/1992 | Chevalier et al. | 62/36 |
| 5,410,885 | 5/1995 | Smolarek et al. | 62/25 |
| 5,461,870 | 10/1995 | Paradowski | 62/11 |
| 5,740,683 | 4/1998 | Billingham et al. | 62/644 |
| 5,921,108 | 7/1999 | Bonaquist | 62/643 |

*Primary Examiner*—Corrine McDermott
*Assistant Examiner*—Malik N. Drake
(74) *Attorney, Agent, or Firm*—Stanley Ktorides

(57) ABSTRACT

A cryogenic separation arrangement wherein feed air is processed simultaneously through two regenerator systems and then separated in a reflux condenser, with product and waste from the reflux condenser processed through one and the other respectively of the regenerator systems.

10 Claims, 2 Drawing Sheets

CRYOGENIC REFLUX CONDENSER SYSTEM FOR PRODUCING OXYGEN-ENRICHED AIR

TECHNICAL FIELD

This invention relates generally to air separation for the production of lower purity products wherein a column is not employed.

BACKGROUND ART

Oxygen-enriched air is widely used in a number of applications such as in furnace operations and chemical oxidation processes. While lower purity oxygen may be produced with a system using distillation columns, such systems are generally not economical for producing oxygen-enriched air. Oxygen-enriched air may be produced with a system employing reflux condensers, and it is desirable to produce oxygen-enriched air with a reflux condenser system with improved efficiency over known such systems.

Accordingly, it is an object of this invention to provide a reflux condenser system for producing oxygen-enriched air which operates with improved efficiency compared to conventional reflux condenser systems.

Often it is desirable to also produce lower purity nitrogen in addition to oxygen-enriched air in the production facility so as to use the lower purity nitrogen for inerting, drying or blanketing at the same location where the oxygen-enriched air is used.

Accordingly, it is a further object of this invention to provide a reflux condenser system for producing oxygen-enriched air which operates with improved efficiency compared to conventional reflux condenser systems and which can also effectively produce lower purity nitrogen.

SUMMARY OF THE INVENTION

The above and other objects, which will become apparent to those skilled in the art upon a reading of this disclosure, are attained by the present invention, one aspect of which is:

A method for producing oxygen-enriched air comprising:

(A) dividing feed air into a first portion comprising from 25 to 45 percent of the feed air and into a second portion comprising from 55 to 75 percent of the feed air;

(B) passing the first portion of the feed air through a first regenerator wherein said first portion is cooled and cleaned of high boiling impurities, and passing the second portion of the feed air through a second regenerator wherein said second portion is cooled and cleaned of high boiling impurities;

(C) passing the cooled and cleaned first and second portions of the feed air into and up the condensing side of a reflux condenser having a condensing side and a vaporizing side and condensing a portion of said upwardly flowing feed air to form a first vapor portion and a first liquid portion;

(D) passing the first liquid portion into and down the vaporizing side of the reflux condenser and vaporizing a portion of said downwardly flowing first liquid portion to form a second vapor portion and a second liquid portion; and (E) vaporizing said second liquid portion and recovering the resulting vaporized second liquid portion as product oxygen-enriched air.

Another aspect of the invention is:

Apparatus for producing oxygen-enriched air comprising:

(A) at least two first regenerators, at least two second regenerators, means for providing feed air to the first regenerators, and means for providing feed air to the second regenerators;

(B) a primary heat exchanger, means for passing feed air from the first regenerators to the primary heat exchanger, and means for passing feed air from the second regenerators to the primary heat exchanger;

(C) a reflux condenser having a vaporizing side and a condensing side, means for passing feed air from the primary heat exchanger into the condensing side of the reflux condenser, and means for passing fluid from the condensing side of the reflux condenser into the vaporizing side of the reflux condenser;

(D) means for passing fluid from the condensing side of the reflux condenser to the primary heat exchanger and from the primary heat exchanger to the second regenerators; and (E) means for passing fluid from the vaporizing side of the reflux condenser to the primary heat exchanger and from the primary heat exchanger to the first regenerators, and means for recovering product oxygen-enriched air from the first regenerators.

As used herein, the term "feed air" means a mixture comprising primarily nitrogen and oxygen, such as ambient air.

As used herein, the terms "turboexpansion" and "turboexpander" mean respectively method and apparatus for the flow of high pressure gas through a turbine to reduce the pressure and the temperature of the gas.

As used herein, the term "indirect heat exchange" means the bringing of two fluids into heat exchange relation without any physical contact or intermixing of the fluids with each other.

As used herein, the term "regenerator" means a reversible periodic heat exchanger through which gases flow in an alternating fashion and in which heat in transit is temporarily stored in a packing material of high thermal capacity.

As used herein, the term "reflux condenser" means a heat exchange device containing a plurality of vertically oriented finned tubes or passages for the flow of vapor from the bottom to the top of the tubes or passages, collectively termed the condensing side of the reflux condenser, and a plurality of vertically oriented finned tubes or passages for the flow of liquid from the top to the bottom of the tubes or passages, collectively termed the vaporizing side of the reflux condenser. Each condensing tube or passage is in heat exchange relationship with at least one vaporizing tube or passage such that the vapor rising through the condensing tubes or passages is partially condensed by indirect heat exchange with the liquid flowing down the vaporizing tubes or passages which is partially vaporized.

DETAILED DESCRIPTION

Figure 1:
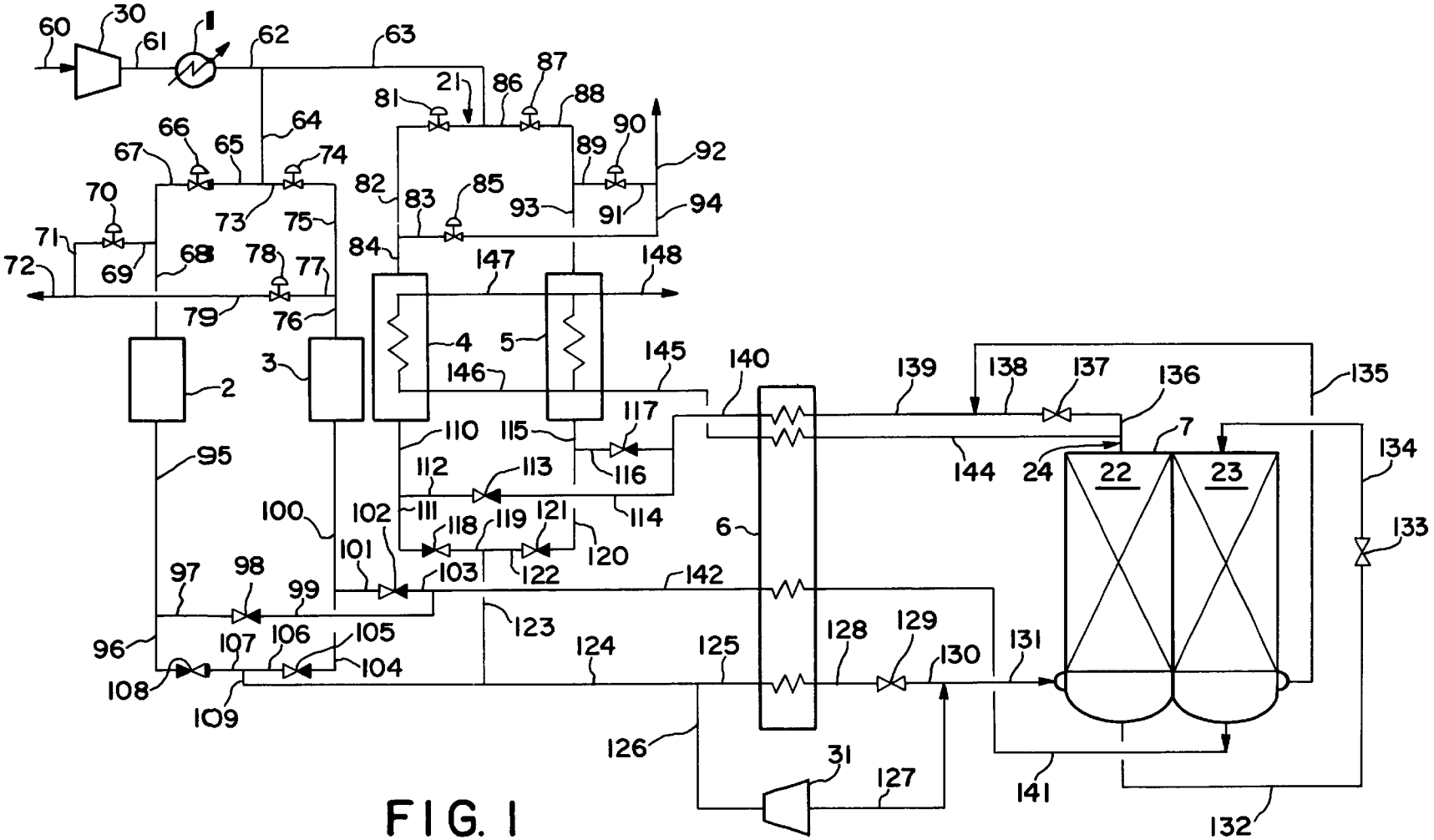
FIG. 1 is a schematic representation of one preferred embodiment of the invention wherein feed air turboexpansion is employed to provide the requisite cryogenic temperatures.

The invention will be described in greater detail with reference to the Drawings. Referring now to FIG. 1, feed air 60 is compressed to a pressure generally within the range of from 45 to 70 pounds per square inch absolute (psia) by passage through compressor 30. Resulting compressed feed air 61 is cooled of the heat of compression by passage through aftercooler 1, and the resulting feed air 62 is divided into a first portion 64 comprising from 25 to 45 percent, preferably from 30 to 40 percent, of feed air 62, and into second portion 63 comprising from 55 to 75 percent, preferably from 60 to 70 percent, of feed air 62. First feed air portion 64 is passed through one of at least two first regenerators which in the embodiment of the invention illustrated in FIG. 1 are regenerators 2 and 3, and second feed air portion 63 is passed through one of at least two second regenerators which in the embodiment of the invention illustrated in FIG. 1 are regenerators 4 and 5. For purposes of this discussion of the invention it will be assumed that the feed air is passing through regenerators 2 and 4 while the return streams are passing through regenerators 3 and 5, with the understanding that these flows are periodically changed so that the feed air passes through regenerators 3 and 5 while the return streams pass through regenerators 2 and 4.

Referring back now to FIG. 1, first feed air portion 64 is passed in piping 65 through valve 66 and piping 67 and 68 to first regenerator 2. In the aforesaid alternate operating mode, first feed air portion 64 would be passed in piping 73 through valve 74 and through piping 75 and 76 into first regenerator 3. Within the first regenerator the first feed air portion is cooled and cleaned of high boiling impurities such as carbon dioxide and water vapor which condense and plate out on the internals of the first regenerator. Cooled, cleaned feed air first portion 95 is then passed through piping 96, valve 108 and piping 107 to form feed air stream 109. In the alternate operating mode, cooled, cleaned feed air first portion 100 would be passed through piping 104, valve 105 and piping 106 to form feed air stream 109. Second feed air portion 63 is passed in piping 21 through valve 81 and piping 82 and 84 to second regenerator 4. In the alternate operating mode, second feed air portion 63 would be passed in piping 86 through valve 87 and piping 88 and 93 to second regenerator 5. Within the second regenerator the second feed air portion is cooled and cleaned of high boiling impurities such as carbon dioxide and water vapor which condense and plate out on the internals of the second regenerator. Cooled, cleaned feed air second portion 110 is then passed through piping 111, valve 118 and piping 119 to form feed air stream 123. In the alternate operating mode, cooled cleaned feed air second portion 115 would be passed through piping 120, valve 121 and piping 122 to form feed air stream 123.

The first feed air portion 109 and the second feed air portion 123 are passed, at least in part, through primary heat exchanger 6 and then the entire feed air is passed into reflux condenser 7 which has a condensing side and a vaporizing side illustrated in representational fashion in FIG. 1 as condensing side 22 and vaporizing side 23. In the preferred embodiment of the invention illustrated in FIG. 1, first feed air portion 109 and second feed air portion 123 are combined to form feed air stream 124. A portion 125 of feed air stream 124 is passed through primary heat exchanger 6 wherein it is cooled and partially condensed by indirect heat exchange with return streams, emerging from primary heat exchanger 6 as stream 128 which is passed through valve 129 to form stream 130. Another portion 126 of feed air stream 124 is turboexpanded by passage through turboexpander 31 to generate refrigeration. Resulting refrigeration bearing feed air stream 127 is combined with stream 130 to form stream 131 which comprises the first and second portions of the feed air and which is passed into the condensing side of reflux condenser 7.

The liquid portion of feed air stream 131 passes to the bottom of condensing side 22 while the vapor portion passes up condensing side 22 and is progressively partially condensed by indirect heat exchange with downflowing liquid in the vaporizing side 23 of reflux condenser 7 to form a first vapor portion and a first liquid portion. The first liquid portion passes to the bottom of condensing side 22 where it is combined with the existing liquid and passed in stream 132 through valve 133 and piping 134 into the vaporizing side 23 of reflux condenser 7 wherein it forms the aforesaid downflowing liquid.

The first vapor portion is withdrawn from the condensing side 22 of reflux condenser 7 in stream 24 and passed through piping 136, valve 137, and piping 138 and 139 to and through primary heat exchanger 6 wherein it is warmed by indirect heat exchange with the cooling feed air.

Resulting stream 140 is passed through valve 117 and piping 116 and 115 to second regenerator 5 wherein it serves to pick up plated out low boiling impurities and to cool the second regenerator so as to make it ready to receive feed air in the alternate operating mode. The resulting impurity-containing vapor emerges from second regenerator 5 in piping 93 and is passed in piping 89 through valve 90 and piping 91 and 92 out of the system. In the alternate operating mode, stream 140 would be passed in piping 114 through valve 113 and piping 112 and 110 into second regenerator 4, emerging as impurity-containing vapor in piping 84 and then passed in piping 83 through valve 85 and piping 94 and 92 out of the system.

The embodiment illustrated in FIG. 1 is a preferred embodiment wherein a portion of the first vapor portion is recovered as product lower purity nitrogen. Referring back now to FIG. 1, a portion of the first vapor portion is passed in stream 144 through primary heat exchanger 6 wherein it is warmed by indirect heat exchange with feed air, emerging therefrom as stream 145 which is passed through embedded coils within the second regenerators. In the embodiment of the invention illustrated in FIG. 1 a portion 146 of stream 145 passes through second regenerator 4 emerging therefrom as stream 147 which combines with the remaining portion of stream 145 which passes through second regenerator 5 to form stream 148 which is recovered as product lower purity nitrogen fluid having a nitrogen concentration generally within the range of from 95 to 99.9 mole percent.

The liquid passed in stream 134 into vaporizing side 23 of reflux condenser 7 flows downwardly in vaporizing side 23 and is partially vaporized to effect the aforesaid partial condensation in condensing side 22, resulting in the formation of a second vapor portion and a second liquid portion. The second vapor portion is withdrawn from vaporizing side 23 in stream 135 and, as illustrated in FIG. 1, preferably combined with stream 138 to form stream 139 for further processing as previously described.

The second liquid portion is withdrawn from vaporizing side 23 of reflux condenser 7 in stream 141 and passed through primary heat exchanger 6 wherein it is vaporized by indirect heat exchange with feed air. Resulting vapor stream 142 is passed in piping 103 through valve 102 and piping 101 and 100 to first regenerator 3 wherein it picks up previously plated out low boiling impurities, emerging in piping 76. From there it is passed through piping 77, valve 78 and piping 79 to piping 72 from where it is recovered as product oxygen-enriched air being a fluid having an oxygen concentration generally within the range of from 35 to 65 mole percent. If desired, some or all of stream 72 may be combined with air to produce oxygen-enriched air having a somewhat lower oxygen concentration than that of the fluid in stream 72. In the alternate operating mode stream 142 would be passed in piping 99 through valve 98 and piping 97 and 95 into first regenerator 2 wherein it picks up low boiling impurities and from which it emerges in piping 68 and passed in piping 69 through valve 70 and piping 71 to become stream 72 for recovery as product.

Figure 2:
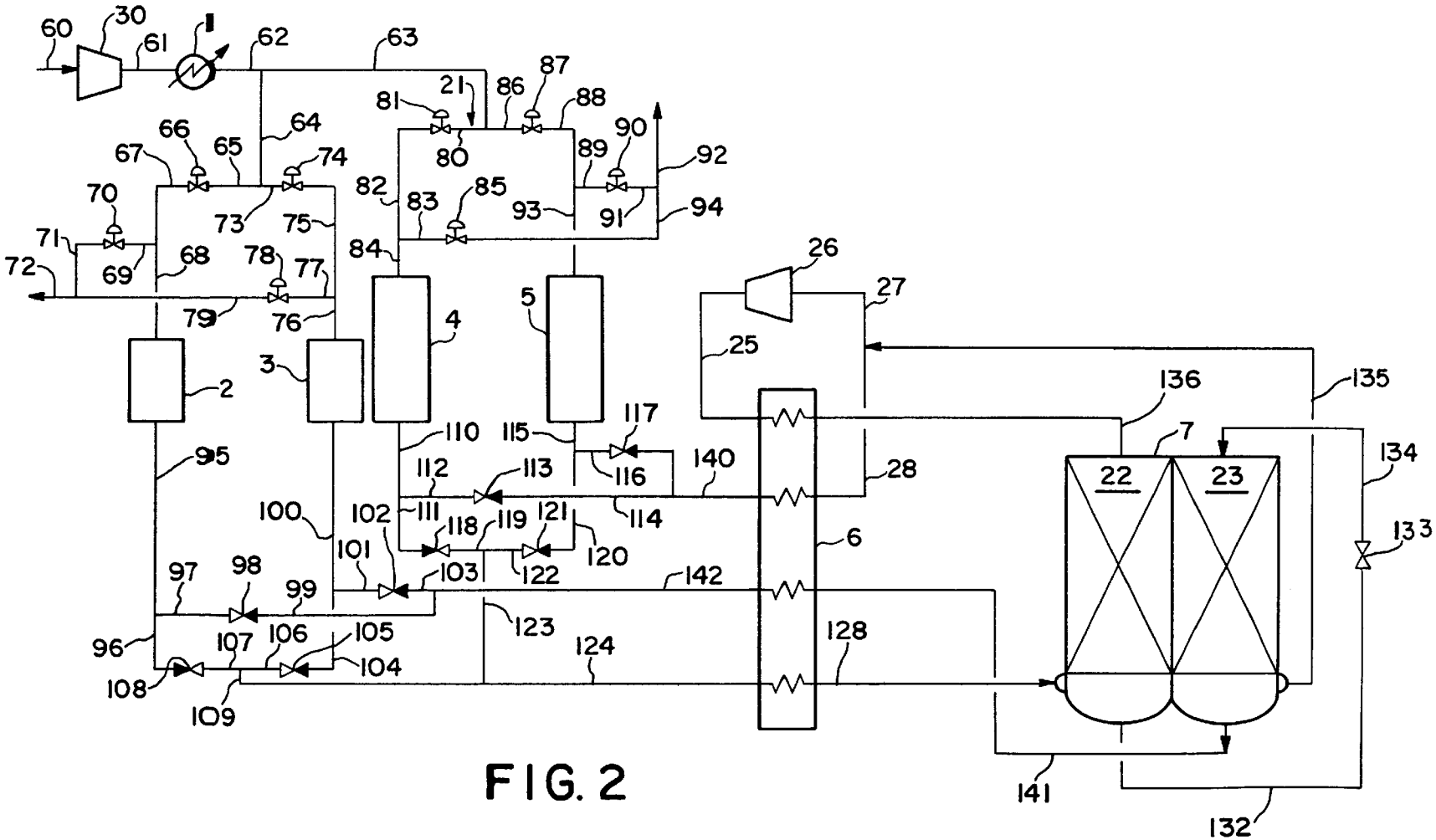
FIG. 2 is a schematic representation of another preferred embodiment of the invention wherein waste fluid turboexpansion is employed to provide the requisite cryogenic temperatures.

FIG. 2 illustrates another embodiment of the invention wherein refrigeration for the cryogenic processing of the feed air is generated by turboexpansion of a waste stream. The numerals in FIG. 2 are the same as those in FIG. 1 for the common elements and these common elements will not be described again in detail. Referring now to FIG. 2, all of feed air stream 124 is passed through primary heat exchanger 6 wherein it is cooled and partially condensed by indirect heat exchange with return streams. Resulting feed air stream 128 is passed into the condensing side 22 of reflux condenser 7. First vapor portion 136 is warmed by passage through primary heat exchanger 6, emerging therefrom as stream 25 which is turboexpanded by passage through turboexpander 26 to generate refrigeration. Resulting refrigeration bearing turboexpanded stream 27 is combined with stream 135 to form stream 28. Stream 28 is passed through primary heat exchanger 6 wherein it is warmed thereby transferring refrigeration for the process to the incoming feed air. The resulting first vapor stream 140 is then processed as previously described in connection with the embodiment of the invention illustrated in FIG. 1.

Although the invention has been described in detail with reference to certain preferred embodiments, those skilled in the art will recognize that there are other embodiments of the invention within the spirit and the scope of the claims.

What is claimed is:

1. A method for producing oxygen-enriched air comprising:

(A) dividing feed air into a first portion comprising from 25 to 45 percent of the feed air and into a second portion comprising from 55 to 75 percent of the feed air;

(B) passing the first portion of the feed air through a first regenerator wherein said first portion is cooled and cleaned of high boiling impurities, and passing the second portion of the feed air through a second regenerator wherein said second portion is cooled and cleaned of high boiling impurities;

(C) passing the cooled and cleaned first and second portions of the feed air into and up the condensing side of a reflux condenser having a condensing side and a vaporizing side and condensing a portion of said upwardly flowing feed air to form a first vapor portion and a first liquid portion;

(D) passing the first liquid portion into and down the vaporizing side of the reflux condenser and vaporizing a portion of said downwardly flowing first liquid portion to form a second vapor portion and a second liquid portion; and (E) vaporizing said second liquid portion and recovering the resulting vaporized second liquid portion as product oxygen-enriched air.

2. The method of claim 1 wherein a portion of the cleaned and cooled first and second feed air portions is turboexpanded prior to passage into the condensing side of the reflux condenser.

3. The method of claim 1 wherein a portion of the first vapor portion is recovered as product lower purity nitrogen.

4. The method of claim 1 wherein at least some of the cleaned and cooled first and second feed air portions is cooled by indirect heat exchange with the first vapor portion and the vaporizing second liquid portion prior to being passed into the condensing side of the reflux condenser.

5. The method of claim 4 wherein the first vapor portion is turboexpanded prior to the said indirect heat exchange with the feed air.

6. Apparatus for producing oxygen-enriched air comprising:

(A) at least two first regenerators, at least two second regenerators, means for providing feed air to the first regenerators, and means for providing feed air to the second regenerators;

(B) a primary heat exchanger, means for passing feed air from the first regenerators to the primary heat exchanger, and means for passing feed air from the second regenerators to the primary heat exchanger;

(C) a reflux condenser having a vaporizing side and a condensing side, means for passing feed air from the primary heat exchanger into the condensing side of the reflux condenser, and means for passing fluid from the condensing side of the reflux condenser into the vaporizing side of the reflux condenser;

(D) means for passing fluid from the condensing side of the reflux condenser to the primary heat exchanger and from the primary heat exchanger to the second regenerators; and (E) means for passing fluid from the vaporizing side of the reflux condenser to the primary heat exchanger and from the primary heat exchanger to the first regenerators, and means for recovering product oxygen-enriched air from the first regenerators.

7. The apparatus of claim 6 further comprising a turboexpander, means for passing feed air to the turboexpander, and means for passing feed air from the turboexpander into the condensing side of the reflux condenser.

8. The apparatus of claim 6 further comprising means for recovering lower purity nitrogen product from the condensing side of the reflux condenser.

9. The apparatus of claim 6 further comprising a turboexpander wherein the means for passing fluid from the condensing side of the reflux condenser to the primary heat exchanger includes the turboexpander.

10. The apparatus of claim 6 further comprising means for passing fluid from the vaporizing side of the reflux condenser to the second regenerators.

* * * * *